US008857341B1

(12) United States Patent
Andrews et al.

(10) Patent No.: US 8,857,341 B1
(45) Date of Patent: Oct. 14, 2014

(54) FLYING PRIMER FOR HAND GRENADE FUZE

(71) Applicants: William J. Andrews, Tampa, FL (US); Carl J. Campagnuolo, Sarasota, FL (US); Vincent Gonsalves, Nazareth, PA (US); Nikola Kotevski, Bloomingdale, NJ (US)

(72) Inventors: William J. Andrews, Tampa, FL (US); Carl J. Campagnuolo, Sarasota, FL (US); Vincent Gonsalves, Nazareth, PA (US); Nikola Kotevski, Bloomingdale, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 14/014,723

(22) Filed: Aug. 30, 2013

(51) Int. Cl.
*F42B 27/00* (2006.01)
*F42C 14/02* (2006.01)

(52) U.S. Cl.
CPC ..... *F42C 14/02* (2013.01)
USPC ..... 102/488; 102/486; 102/487

(58) Field of Classification Search
CPC ..... F42C 14/02
USPC ..... 102/487, 486, 368, 261, 281, 275.11, 102/202, 204, 206, 221
See application file for complete search history.

(56) References Cited

U.S. PATENT DOCUMENTS

| | | | | |
|---|---|---|---|---|
| 3,340,810 | A * | 9/1967 | Di Paola | 102/487 |
| 3,392,671 | A * | 7/1968 | Hinzmann | 102/261 |
| 3,434,421 | A * | 3/1969 | Berlin et al. | 102/487 |
| 3,657,958 | A * | 4/1972 | Wells | 89/1.14 |
| 3,823,669 | A * | 7/1974 | Zacharin | 102/221 |
| 4,333,401 | A * | 6/1982 | Byers et al. | 102/487 |
| 4,926,752 | A * | 5/1990 | DiRubbio et al. | 102/486 |
| 5,355,803 | A * | 10/1994 | Robinet et al. | 102/487 |
| 8,453,573 | B1 * | 6/2013 | McKimm et al. | 102/487 |
| 8,561,540 | B1 * | 10/2013 | Lauch | 102/258 |
| 2006/0283346 | A1 * | 12/2006 | Luebbers et al. | 102/487 |
| 2010/0224092 | A1 * | 9/2010 | Kapeles et al. | 102/368 |
| 2012/0240806 | A1 * | 9/2012 | Gonsalves et al. | 102/275.11 |
| 2014/0013986 | A1 * | 1/2014 | Mendes et al. | 102/487 |

* cited by examiner

*Primary Examiner* — Michelle R Clement
(74) *Attorney, Agent, or Firm* — Henry S. Goldfine

(57) ABSTRACT

A more IM compliant grenade fuze assembly includes a fuze body, an energetics train disposed in the fuze body, and a striker lever rotatably attached to the fuze body. A spring-loaded rotor assembly is rotatably fixed to the fuze body. The rotor assembly includes a primer. A firing pin is disposed in one of the rotor assembly and the fuze body. Placing the primer in the rotor assembly decreases the area of the fuze assembly that is vulnerable to initiation by impact from a bullet, fragment, or shape charge.

11 Claims, 11 Drawing Sheets

FLYING PRIMER FOR HAND GRENADE FUZE

STATEMENT OF GOVERNMENT INTEREST

The inventions described herein may be manufactured, used and licensed by or for the United States Government.

BACKGROUND OF THE INVENTION

The invention relates in general to insensitive munitions, and in particular to hand grenades.

A major concern in the field of munition fuzes is the ability of the fuzes to comply with Insensitive Munitions (IM) standards. Stimuli such as impacts from bullets, fragments and shape charges are difficult IM challenges for fuzes, such as grenade fuzes. Known hand grenade fuzes have the fuze primer located in the fuze body and the firing pin located in the rotor assembly.

FIG. 1A is a sectional view of a known grenade fuze assembly 10. Fuze assembly 10 includes a fuze body 12 with a striker lever 14 rotatably mounted thereon. A rotor assembly 16 including a firing pin 18 is rotatably mounted to body 12. A spring 20 torsionally biases rotor assembly 16 in a counterclockwise direction. FIG. 1B shows striker lever 14 and rotor assembly 16 in rotation. FIG. 1C shows firing pin 18 impacting primer 22. The impact of firing pin 18 ignites primer 22. Primer 22 initiates an energetics train 24 disposed in fuze body 12. Energetics train 24 may include, for example, a delay mix 26, lead styphnate 28, lead azide 30, and RDX 32, as referenced in FIGS. 1A, 1C, 2A, and 4.

Even if striker lever 14 and rotor assembly 16 are secured in the unarmed state of FIG. 1A using a pull pin (not shown), primer 22 may ignite if impacted by a bullet, fragment, or shape charge, thus creating a shock-induced catastrophic initiation. The initiation is catastrophic because, in grenade fuze assembly 10, primer 22 is in line with energetics train 24.

A need exists for a grenade fuze assembly that is less sensitive to impacts from, for example, bullets, fragments, or shape charges.

SUMMARY OF INVENTION

One aspect of the invention is a grenade fuze assembly including a fuze body and an energetics train disposed in the fuze body. A striker lever is rotatably attached to the fuze body. A spring-loaded rotor assembly is rotatably fixed to the fuze body. The rotor assembly includes a primer.

In one embodiment, the rotor assembly includes a firing pin aligned with the primer and the grenade fuze assembly includes an anvil disposed in the fuze body. The anvil has a through hole aligned with the energetics train. Upon rotation of the rotor assembly, the primer contacts the anvil, impacts the firing pin and initiates.

In another embodiment, the firing pin is disposed in the fuze body in alignment with the energetics train. Upon rotation of the rotor assembly, the primer impacts the firing pin and initiates.

Another aspect of the invention is a method. The method includes providing a grenade fuze assembly having a fuze body and a spring-loaded rotor assembly rotatably fixed to the fuze body. The rotor assembly includes a primer. The method includes rotating the rotor assembly.

In one embodiment of the method, a firing pin is disposed in the rotor assembly and an anvil is disposed in the fuze body. The rotating step includes includes impacting the anvil with the primer.

In another embodiment of the method, a firing pin is disposed in the fuze body and the rotating step includes impacting the primer with the firing pin to initiate the primer.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION

In a novel grenade fuze assembly, the primer is located away from the energetics train to improve the IM characteristics of the fuze assembly. In one embodiment of the novel fuze assembly, the primer is placed in the rotor assembly with the firing pin. When the grenade fuze is activated by pulling the grenade pull ring, the rotor assembly rotates and the primer in the rotor assembly strikes an anvil in the fuze body, causing the primer to impact the firing pin in the rotor assembly. The potential for initiation of the energetics train by unintended initiation of the primer is eliminated because the primer cannot engage the energetics train until the rotor assembly has rotated the primer in line with the energetics train. The impact of a bullet, shape charge, or fragment on the primer cannot initiate the remaining energetics train.

Figure 1A:
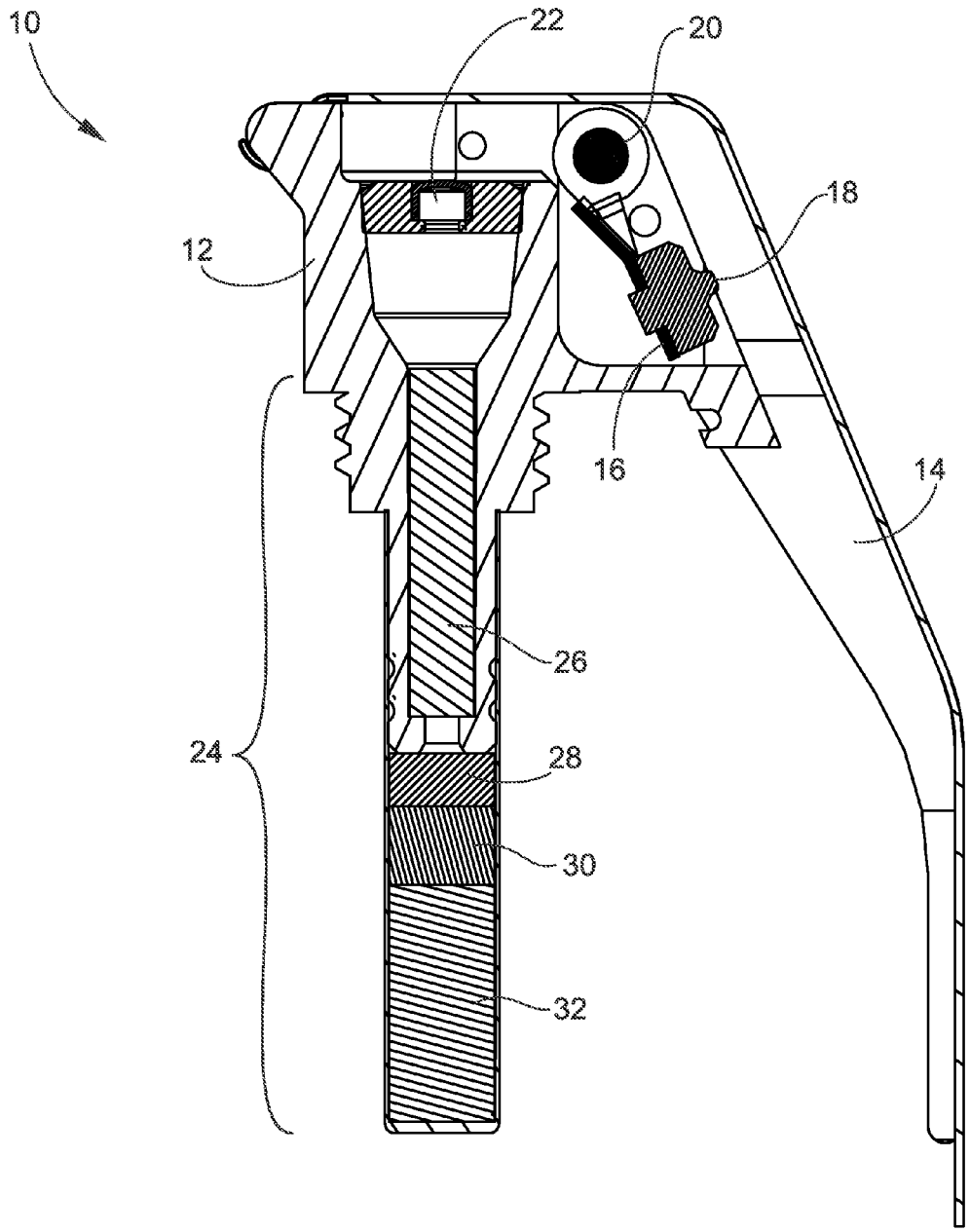
Fig. 1A Prior Art
FIG. 1A is a sectional view of a known grenade fuze assembly.
Figure 1B:
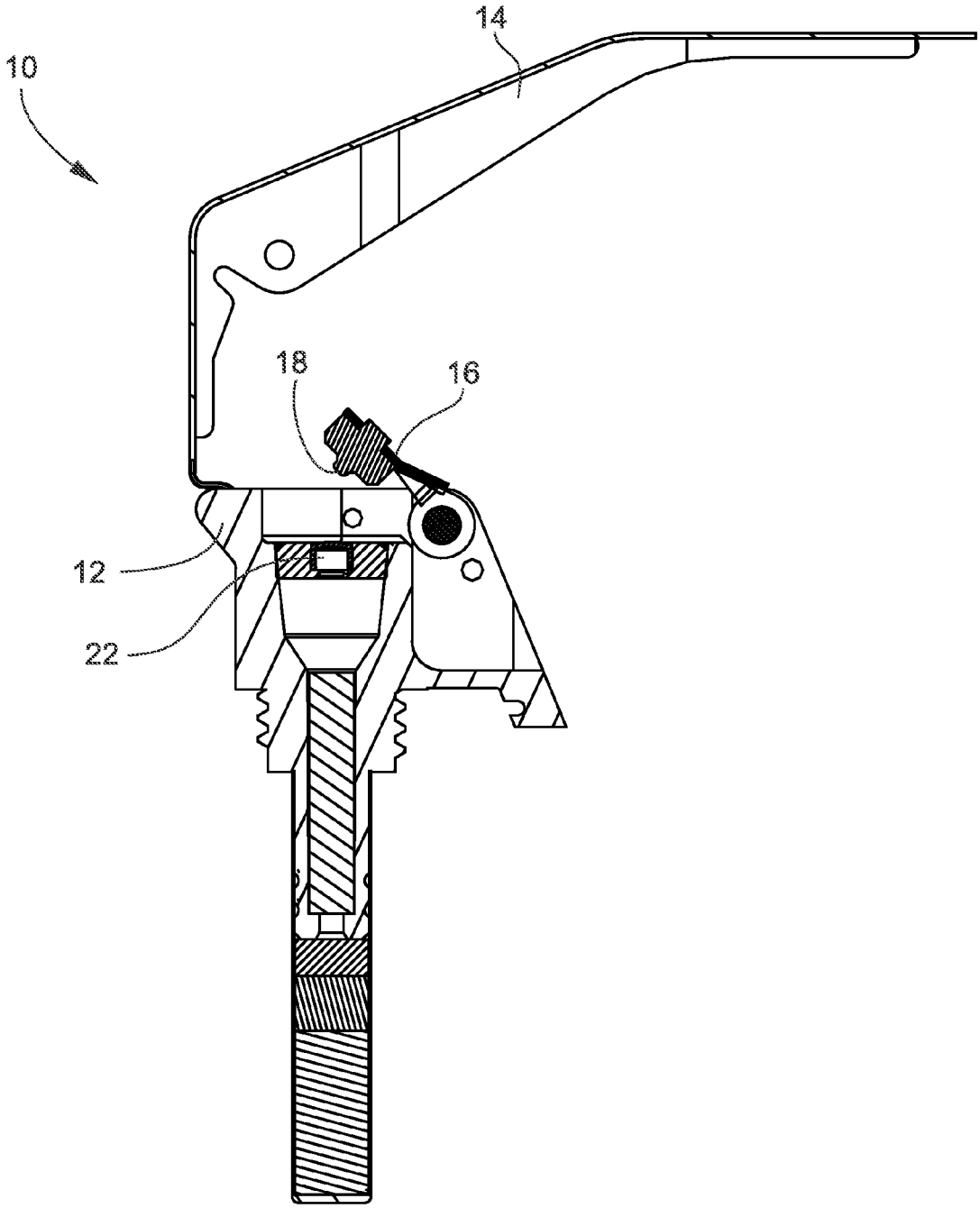
Fig. 1B Prior Art
FIG. 1B shows the fuze assembly of FIG. 1A with the striker lever and firing pin in rotation.
Figure 1C:
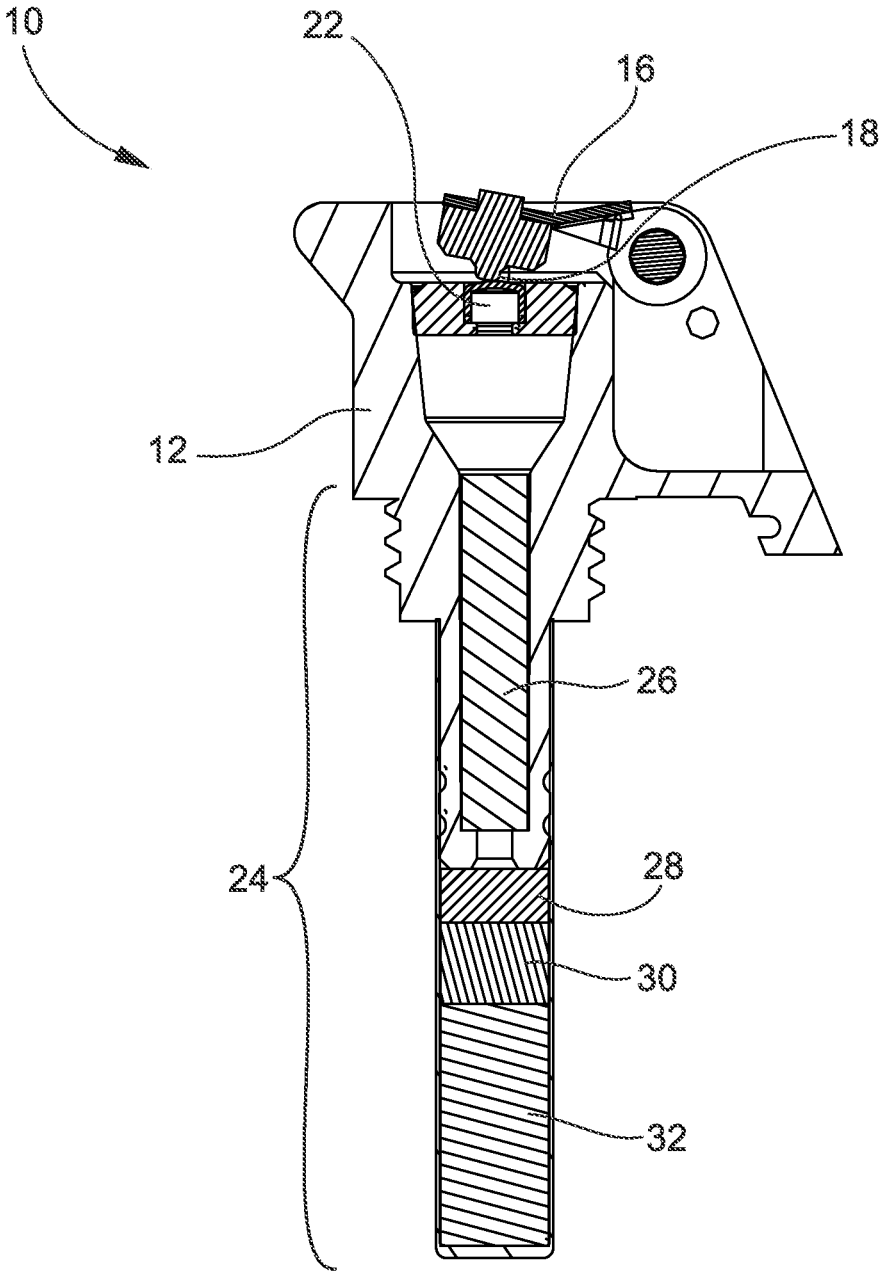
Fig. 1C Prior Art
FIG. 1C shows the fuze assembly of FIG. 1B as the firing pin impacts the primer.
Figure 2A:
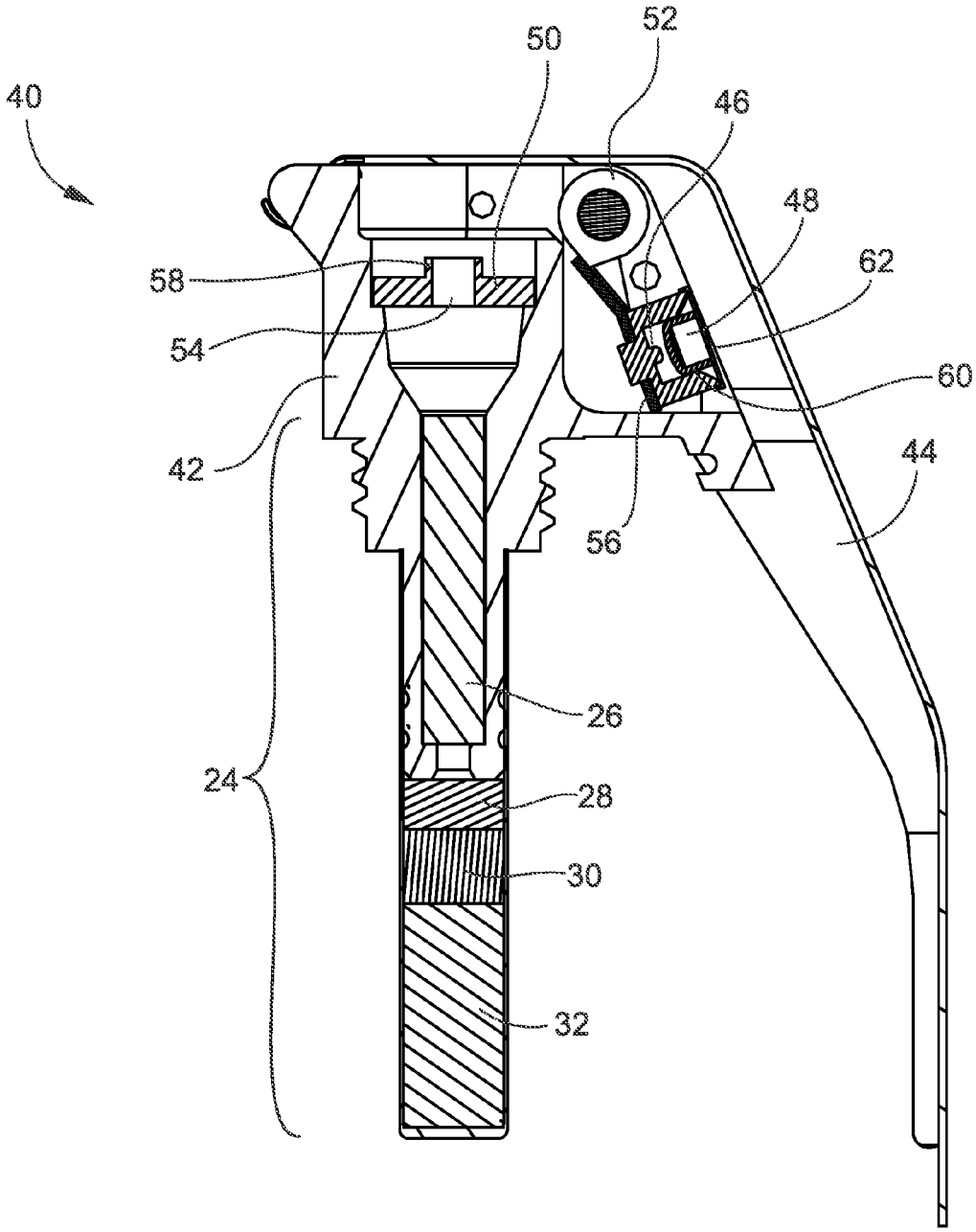
FIG. 2A is a sectional view of one embodiment of a novel grenade fuze assembly.

FIG. 2A is a sectional view of one embodiment of a novel grenade fuze assembly 40. Fuze assembly 40 includes a fuze body 42 and a striker lever 44 rotatably attached to fuze body 42. A spring-loaded rotor assembly 56 is rotatably fixed to fuze body 42. Rotor assembly 56 includes a firing pin 46 and a primer 48 aligned with firing pin 46. An anvil 50 is disposed in fuze body 42. An energetics train 24 is disposed in fuze body 42. Energetics train 24 may include, for example, a delay mix 26, lead styphnate 28, lead azide 30, and RDX 32, as referenced in FIGS. 1A, 1C, 2A, and 4.

Figure 2B:
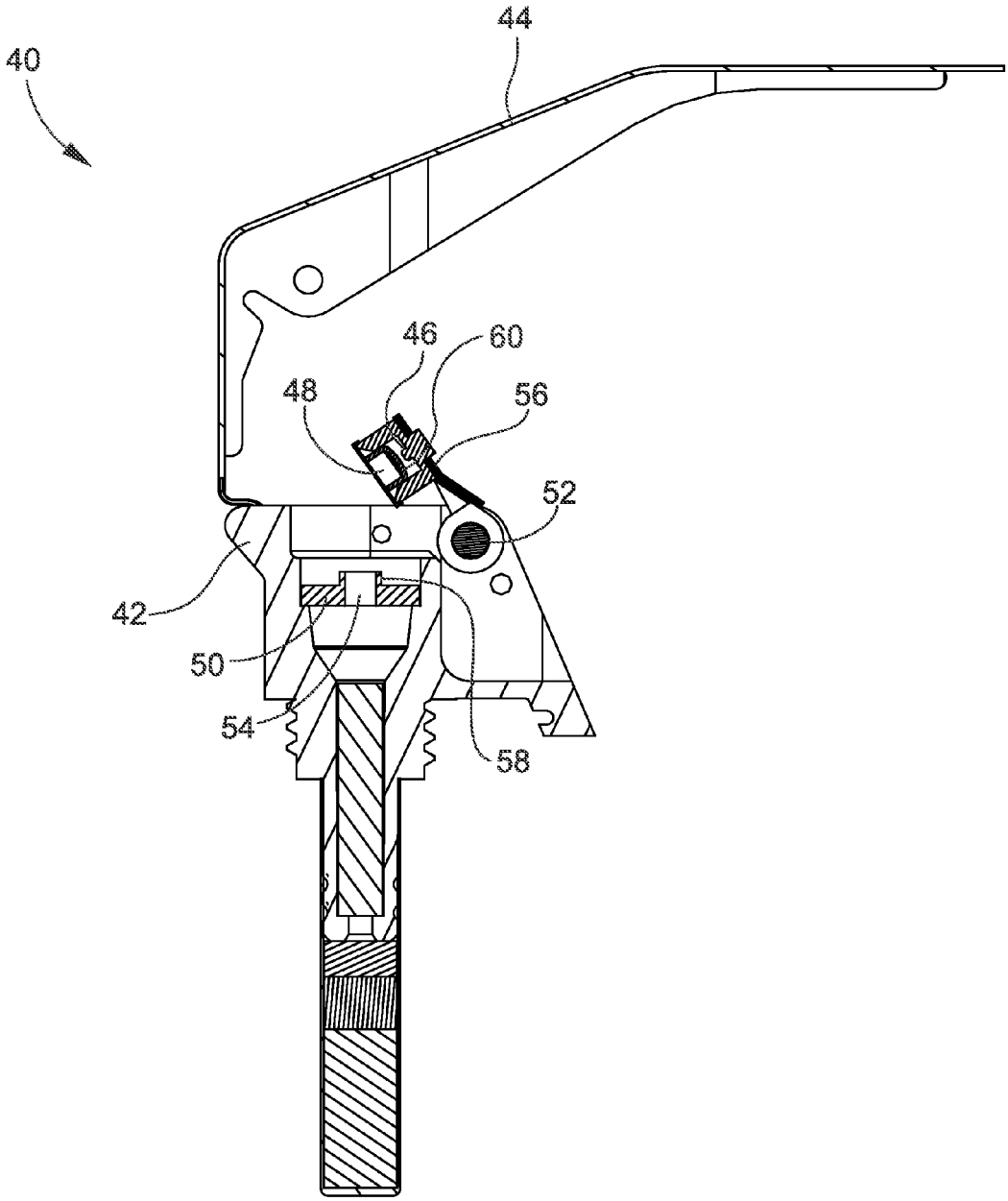
FIG. 2B shows the fuze assembly of FIG. 2A with the striker lever and primer in rotation.
Figure 2C:
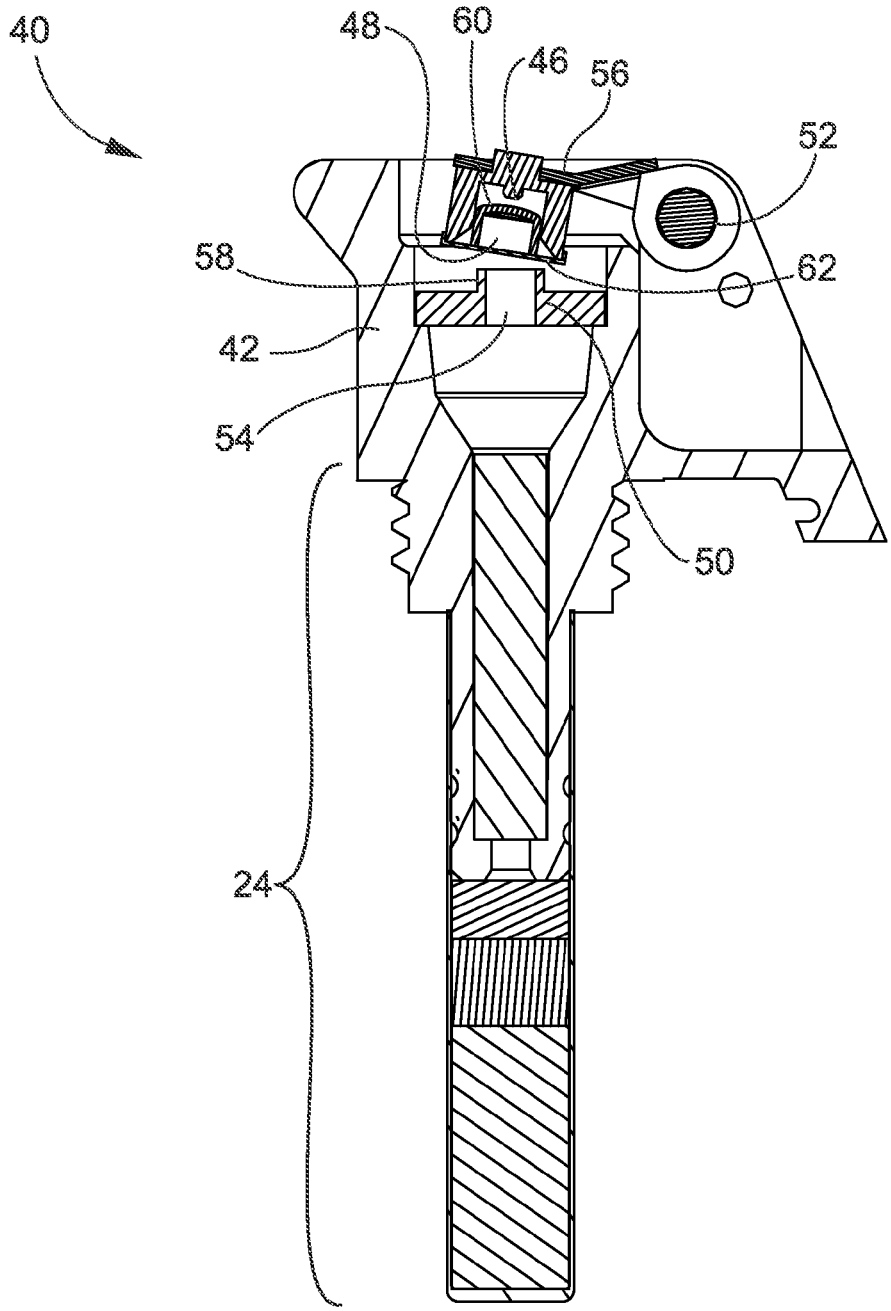
FIG. 2C shows the fuze assembly of FIG. 2B just prior to the primer striking the anvil.

When the grenade pull pin (not shown) is pulled from fuze body 42, torsion spring 52 rotates rotor assembly 56 counterclockwise, as seen in FIG. 2B. Upon rotation of rotor assembly 56, primer 48 strikes anvil 50, which causes primer 48 to impact firing pin 46. FIG. 2C shows fuze assembly 40 just prior to primer 48 striking anvil 50. Primer 48 is ignited by impact with firing pin 46, thereby initiating energetics train 24.

Anvil 50 includes a through hole 54 in alignment with energetics train 24. Anvil 50 may include a raised rim 58. Primer 48 may be disposed in a primer cup 60 closed by a thin environmental seal 62. Referring to FIG. 2C, as cup 60 is rotated towards rim 58, rim 58 will force cup 60 to translate upward, breaking seal 62 and impacting primer 48 against firing pin 46.

Figure 3:
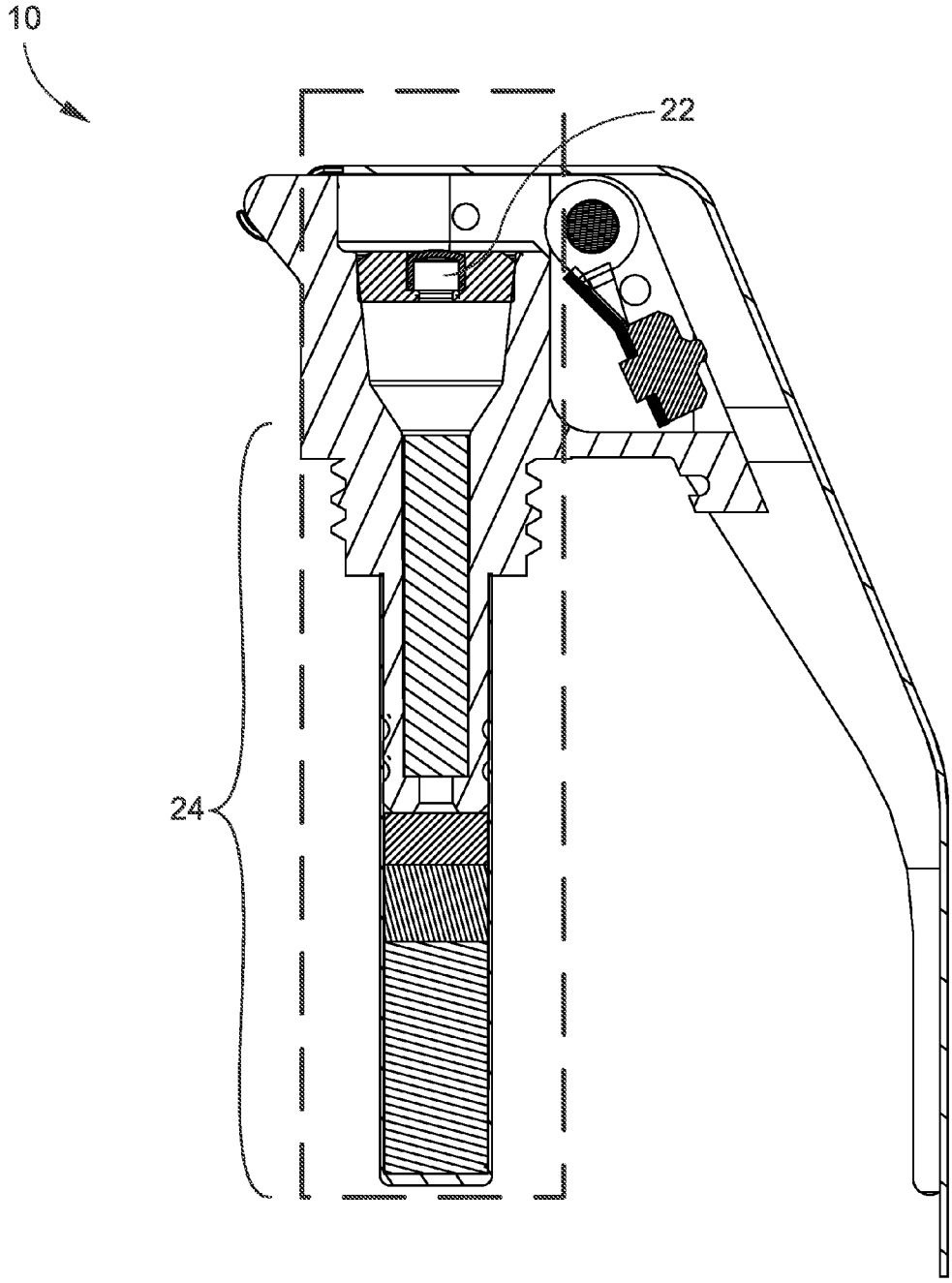
Fig. 3 Prior Art
FIG. 3 shows an area of vulnerability of the fuze assembly of FIG. 1A.
Figure 4:
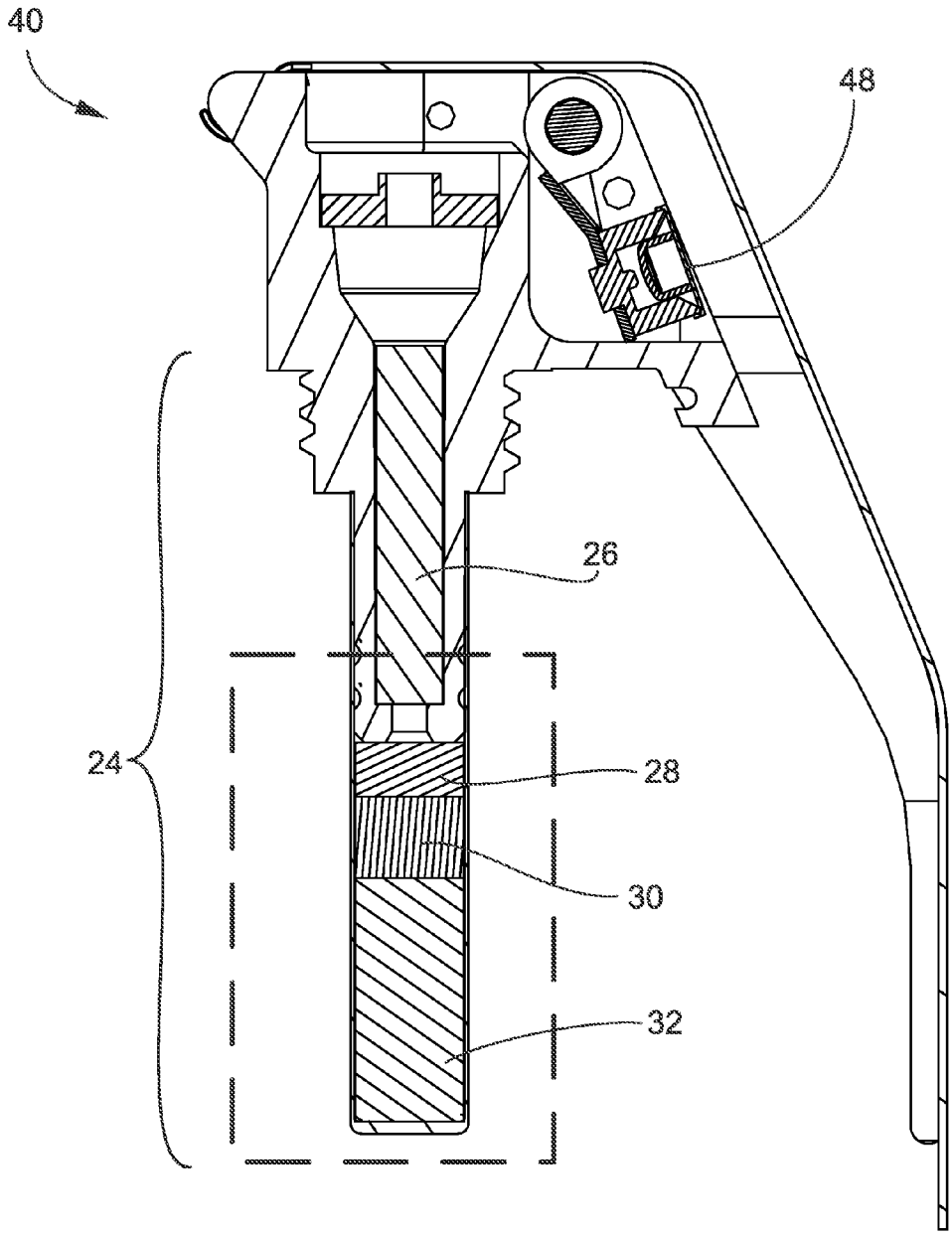
FIG. 4 shows an area of vulnerability of the fuze assembly of FIG. 2A.

FIG. 3 shows the prior art fuze assembly 10 of FIG. 1A. The area inside the rectangle shown in dashed lines in FIG. 3 represents the critical target area in which bullet, fragment, or shape charge impacts, for example, may cause initiation of energetics train 24 of assembly 10. FIG. 4 shows the novel fuze assembly 40 of FIG. 2A. The area inside the rectangle shown in dashed lines in FIG. 4 represents the critical target area in which bullet, fragment, or shape charge impacts, for example, may cause initiation of energetics train 24 of assembly 40. The critical target area for fuze assembly 40 is greatly reduced compared to fuze assembly 10. Delay mix 26 is relatively insensitive to bullet, fragment, or shape charge impacts and cannot initiate the remainder of the energetics train 24, that is, lead styphnate 28, lead azide 30, and RDX 32. In fuze assembly 40, because primer 48 and delay mix 26 are removed as a potential for initiation of energetics train 24, fuze assembly 40 is less sensitive to IM threats and more IM compliant than fuze assembly 10.

Figure 5A:
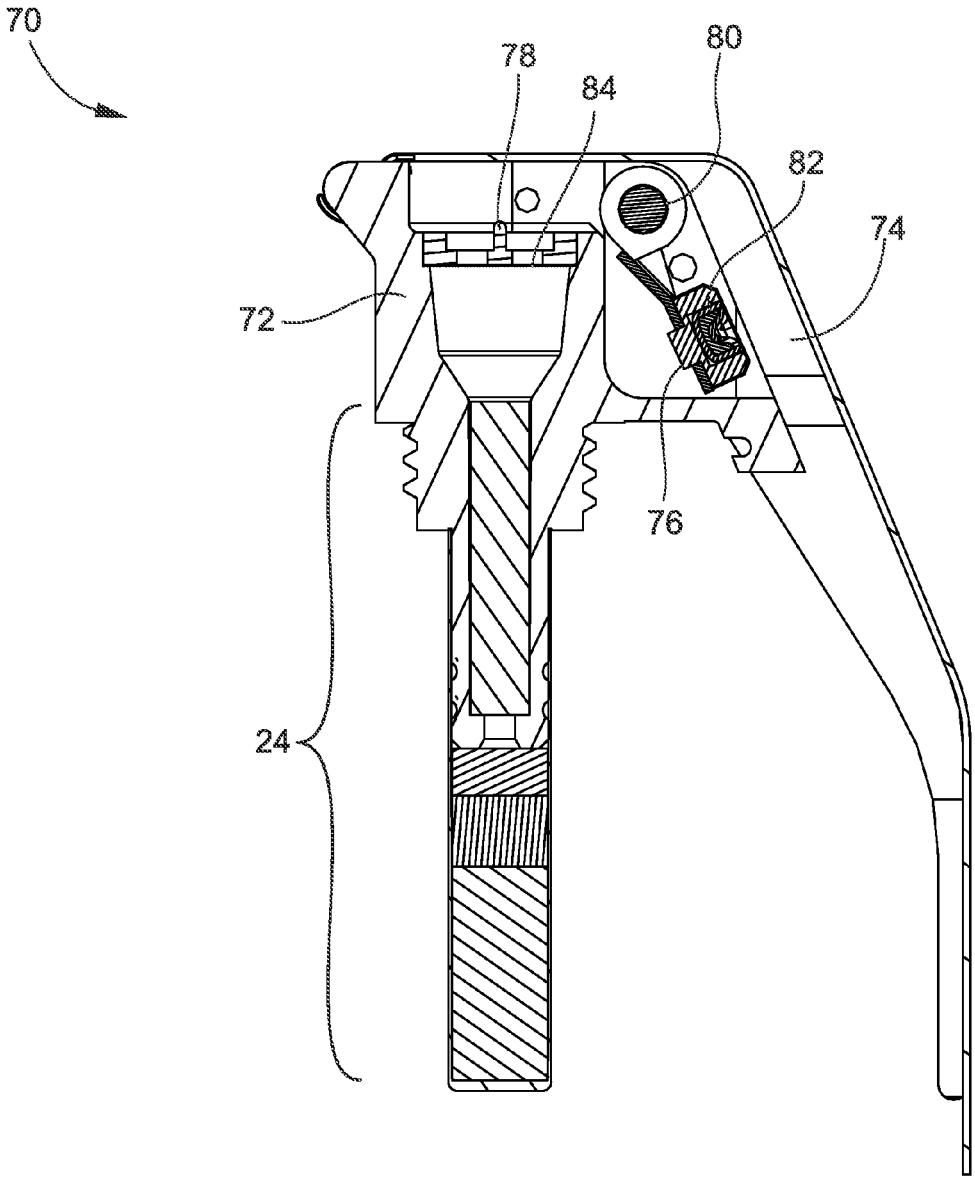
FIG. 5A is a sectional view of another embodiment of a novel grenade fuze assembly.
Figure 5B:
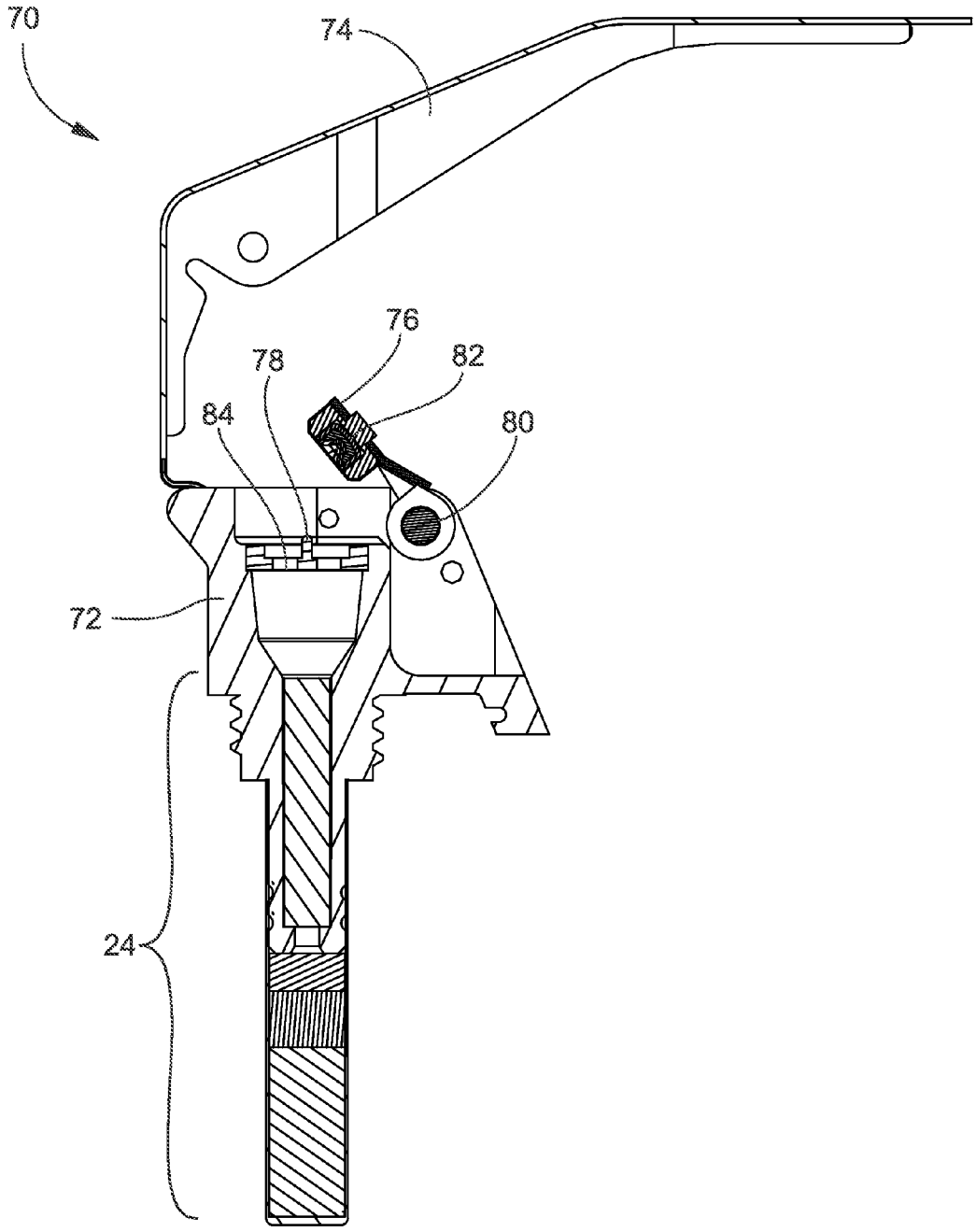
FIG. 5B shows the fuze assembly of FIG. 5A with the striker lever and primer in rotation.
Figure 5C:
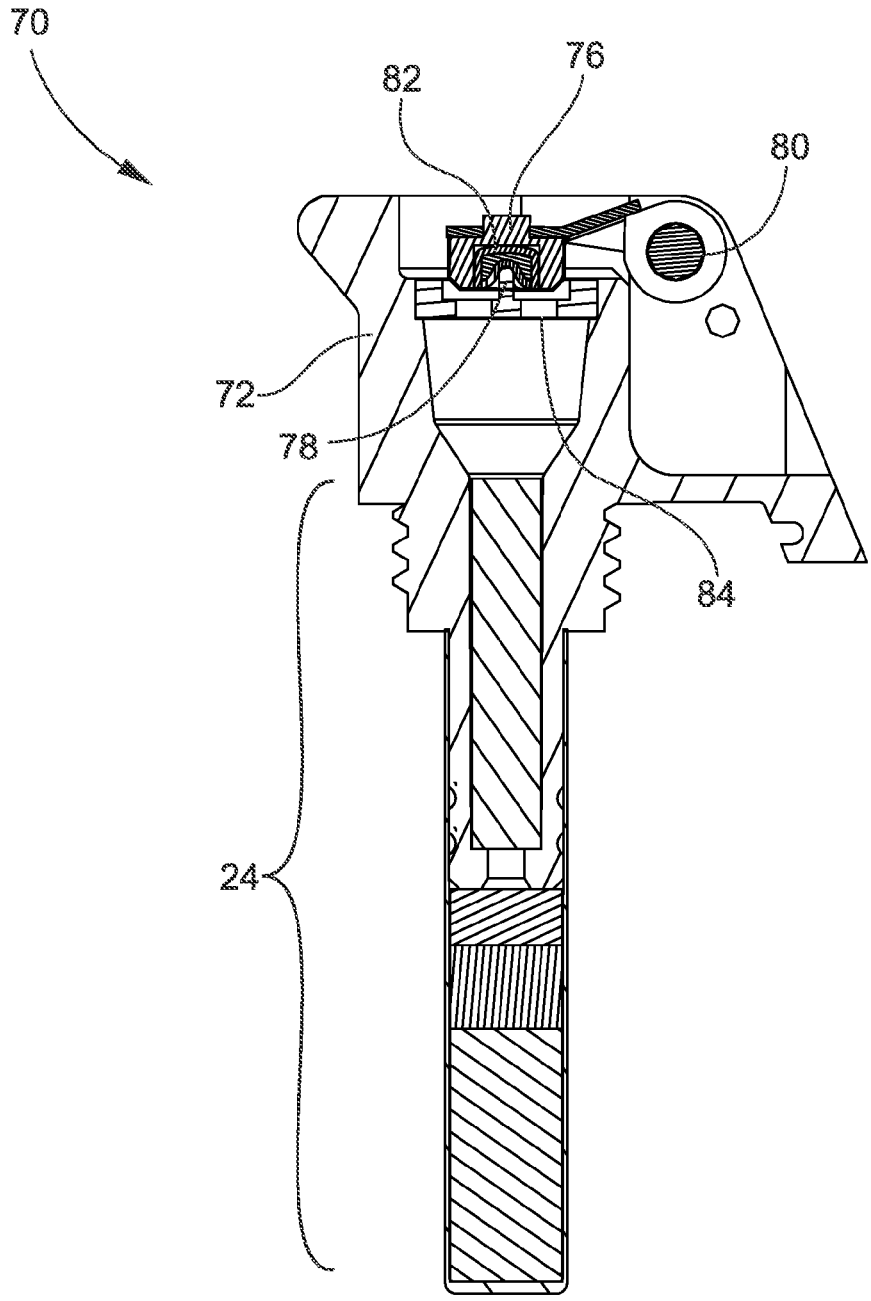
FIG. 5C shows the fuze assembly of FIG. 5B as the primer impacts the firing pin.

FIGS. 5A-C show another embodiment of a novel grenade fuze assembly 70. Fuze assembly 70 includes a fuze body 72 and a striker lever 74 rotatably attached to fuze body 72. A spring-loaded rotor assembly 76 is rotatably fixed to fuze body 72. Rotor assembly 76 includes a primer 82. A firing pin 78 is disposed in fuze body 72 in alignment with an energetics train 24. An annular opening 84 surrounds firing pin 78. Annular opening 84 leads to an energetics train 24. When the grenade pull pin (not shown) is pulled from fuze body 72, a torsion spring 80 rotates rotor assembly 76 counterclockwise, as seen in FIG. 5B. Upon rotation of rotor assembly 76, primer 82 strikes firing pin 78, which causes initiation of primer 82 and subsequently, initiation of energetics train 24.

Compared to grenade fuze assembly 10 (FIG. 3), grenade fuze assembly 70 has a reduced critical impact area that is the same as the reduced critical impact area for grenade fuze assembly 40 (FIG. 4).

While the invention has been described with reference to certain embodiments, numerous changes, alterations and modifications to the described embodiments are possible without departing from the spirit and scope of the invention as defined in the appended claims, and equivalents thereof.

What is claimed is:

1. A grenade fuze assembly comprising:
a fuze body;
an energetics train disposed in the fuze body;
a striker lever rotatably attached to the fuze body; and
a spring-loaded rotor assembly rotatably fixed to the fuze body, the rotor assembly including a primer.

2. The fuze assembly of claim 1, wherein the rotor assembly includes a firing pin aligned with the primer, the assembly further comprising an anvil disposed in the fuze body, the anvil having a through hole aligned with the energetics train, wherein, upon rotation of the rotor assembly, the primer contacts the anvil, impacts the firing pin and initiates.

3. The fuze assembly of claim 1, further comprising a firing pin disposed in the fuze body in alignment with the energetics train, wherein, upon rotation of the rotor assembly, the primer impacts the firing pin and initiates.

4. The fuze assembly of claim 2, wherein the anvil includes a raised rim that, upon contact of the primer with the anvil, translates the primer into impact with the firing pin.

5. The fuze assembly of claim 4, wherein the primer is encased in a cup and a seal that closes the cup.

6. A method, comprising:
providing the fuze assembly of claim 1; and
rotating the rotor assembly.

7. The method of claim 6, wherein the providing step includes providing a firing pin in the rotor assembly and an anvil in the fuze body, and the rotating step includes impacting the anvil with the primer.

8. The method of claim 7, further comprising, after the rotating step, translating the primer into the tiring pin to initiate the primer.

9. The method of claim 6, wherein the providing step includes providing a firing pin disposed in the fuze body in alignment with the energetics train, and the rotating step includes impacting the primer with the firing pin to initiate the primer.

10. A grenade fuze assembly comprising:
a fuze body;
an energetics train disposed in the fuze body;
a striker lever rotatably attached to the fuze body;
a spring-loaded rotor assembly rotatably fixed to the fuze body;
a primer disposed in the rotor assembly, the primer being encased in a cup that is closed with a seal;
a firing pin disposed in the rotor assembly and aligned with the primer; and
an anvil disposed in the fuze body, the anvil having a raised rim and including a through hole aligned with the energetics train, wherein, upon rotation of the rotor assembly, the primer contacts the raised rim, translates into impact with the firing pin, and initiates.

11. A grenade fuze assembly comprising:
a fuze body;
an energetics train disposed in the fuze body;
a striker lever rotatably attached to the fuze body;
a spring-loaded rotor assembly rotatably fixed to the fuze body, the rotor assembly including a primer;
a firing pin disposed in the fuze body in alignment with the energetics train; and
an annular opening formed around the firing pin;
wherein, upon rotation of the rotor assembly, the primer impacts the firing pin and initiates.

* * * * *